US010720131B2

(12) United States Patent
Yamamoto

(10) Patent No.: US 10,720,131 B2
(45) Date of Patent: Jul. 21, 2020

(54) SWITCHING DEVICE AND KEYBOARD DEVICE

(71) Applicant: YAMAHA CORPORATION, Shizuoka (JP)

(72) Inventor: Shin Yamamoto, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/494,847

(22) PCT Filed: Mar. 15, 2018

(86) PCT No.: PCT/JP2018/010260
§ 371 (c)(1),
(2) Date: Sep. 17, 2019

(87) PCT Pub. No.: WO2018/173923
PCT Pub. Date: Sep. 27, 2018

(65) Prior Publication Data

US 2020/0027432 A1 Jan. 23, 2020

(30) Foreign Application Priority Data

Mar. 24, 2017 (JP) ..... 2017-060148

(51) Int. Cl.
*G10H 1/34* (2006.01)

(52) U.S. Cl.
CPC ..... *G10H 1/346* (2013.01)

(58) Field of Classification Search
CPC ... G10H 1/346; G10H 1/055; G10H 2220/285
See application file for complete search history.

(56) References Cited

U.S. PATENT DOCUMENTS 4,375,179 A * 3/1983 Schwartz ..... G10H 1/346 84/435

FOREIGN PATENT DOCUMENTS

JP 05-29097 U 4/1993
JP 11-38976 A 2/1999
(Continued)

OTHER PUBLICATIONS

International Search Report and Written Opinion of PCT Application No. PCT/JP2018/010260, dated May 29, 2018, 07 pages of ISRWO.

*Primary Examiner* — Kimberly R Lockett
(74) *Attorney, Agent, or Firm* — Chip Law Group

(57) ABSTRACT

A switching device includes: an actuator that is rotatable; and a contact member including an upper surface section having a flat portion and is movable in a vertical direction according to rotation of the actuator, and a deformation section disposed between a support member and an end portion of the upper surface section and deformed according to movement of the upper surface section. A chamfer portion interconnecting a contact surface contacting with the contact member and a side surface, of the actuator, is provided between a virtual plane containing an end portion, in an extending direction of the rotary shaft, of the upper surface section, and is perpendicular to the upper surface section and a virtual plane containing an end portion, in the extending direction of the rotary shaft, of a portion where the deformation section makes contact with the support member, and is perpendicular to the upper surface section.

11 Claims, 12 Drawing Sheets

(56) References Cited

FOREIGN PATENT DOCUMENTS

| | | | |
|---|---|---|---|
| JP | 11-175067 | A | 7/1999 |
| JP | 2004-226687 | A | 8/2004 |

* cited by examiner

SWITCHING DEVICE AND KEYBOARD DEVICE

CROSS REFERENCE TO RELATED APPLICATIONS

This application is a U.S. National Phase of International Patent Application No. PCT/JP2018/010260 filed on Mar. 15, 2018, which claims priority benefit of Japanese Patent Application No. JP 2017-060148 filed in the Japan Patent Office on Mar. 24, 2017. Each of the above-referenced applications is hereby incorporated herein by reference in its entirety.

BACKGROUND

The present disclosure relates to a switching device and a keyboard device.

In an acoustic piano, an action of an action mechanism gives a predetermined feeling (hereinafter referred to a touch feeling) to a finger of a player through a key. In the acoustic piano, the action mechanisms may be needed for key depression through hammers. On the other hand, in an electronic keyboard instrument, key depression is detected by a sensor, so that sounds can be generated without provision of action mechanisms such as those of an acoustic piano. A touch feeling of an electronic keyboard instrument which does not use action mechanisms or which uses simple action mechanisms is largely different from the touch feeling of an acoustic piano. In view of this, for obtaining a touch feeling resembling that of an acoustic piano in an electronic keyboard instrument, there has been disclosed a technology in which mechanisms corresponding to the hammers in an acoustic piano are provided (see, for example, Japanese Patent Laid-Open No. 2004-226687).

SUMMARY

In this case, in accordance with a key depressing action of the player, the hammer moves, and the sensor is depressed, whereby a sound is generated. In this case, it is desirable that a force is exerted on a key in a perpendicular direction. However, for example, in a case where the key is located far from the player or in a case where the key is strongly depressed, the force may not be exerted in the perpendicular direction, and a force in a direction (lateral direction) of arrangement of the keys may be added. This may cause the sensor to fail to operate stably, and may cause defective sound generation.

Thus, there is a need for achieving stable sound generation upon key depression by a player playing an electronic keyboard instrument.

According to an embodiment of the present disclosure, there is provided a switching device including: a rotatable actuator; and a contact member including an upper surface section that has a flat portion and movable in a vertical direction according to rotation of the actuator, and a deformation section that is disposed between a support member and an end portion of the upper surface section and deforms according to movement of the upper surface section. In a sectional view in a direction perpendicular to a rotary shaft of the actuator and parallel to the support member, a chamfer portion interconnecting a contact surface for contact with the contact member and a side surface, of the actuator, is provided between a virtual plane that contains an end portion in regard of an extending direction of the rotary shaft of the upper surface section of the contact member and that is perpendicular to the upper surface section and a virtual plane that contains an end portion in regard of the extending direction of the rotary shaft of a portion where the deformation section of the contact member makes contact with the support member and that is perpendicular to the upper surface section.

In the switching device as above, the chamfer portion may have a tangential shape.

In the switching device as above, the contact surface of the actuator may be provided with a plurality of projections.

In the switching device as above, the plurality of projections may be rounded.

In the switching device as above, the contact surface may have a flat surface. In addition, the chamfer portion may be formed at a connection portion between the flat surface and the side surface.

In the switching device as above, the contact surface may have a curved surface.

In the switching device as above, the contact surface may have a projection.

According to an embodiment of the present disclosure, there is provided a keyboard device including the switching device as above, in which the actuator is a hammer.

According to another embodiment of the present disclosure, there is provided a keyboard device including the switching device as above, in which the actuator is a key.

According to a further embodiment of the present disclosure, there is provided a keyboard device including the switching device as above, in which the actuator is a movable member which is operated in conjunction with a key or a hammer.

In accordance with the present disclosure, it can be ensured that stable sound generation is achieved upon key depression by a player playing an electronic keyboard instrument.

DETAILED DESCRIPTION OF THE PREFERRED EMBODIMENTS

Figure 1:
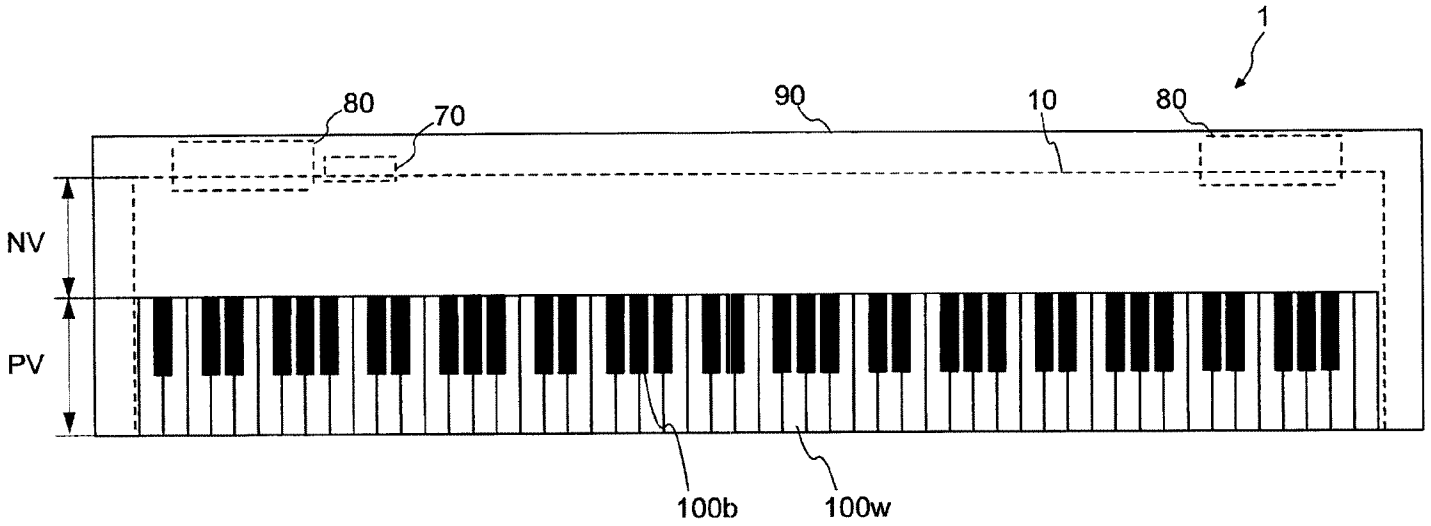
FIG. 1 illustrate the configuration of a keyboard device in a first embodiment.

A keyboard device according to an embodiment of the present disclosure will be described in detail below, referring to the drawings. The embodiments described below are merely examples of the embodiments of the present disclosure, and the present disclosure is not to be construed as limited to these embodiments. Note that in the drawings referred to in the embodiments, the same parts or the parts having the same or similar functions are denoted by the same or similar reference symbols (symbols having numerals followed by a, b or the like) and repeated descriptions of them may be omitted. In addition, the dimensional ratios (the ratios between components, the ratios between dimensions in the longitudinal, transverse and height directions, etc.) in the drawings may be different from the actual ones, for the convenience of explanation, or part of the components may be omitted from the drawings.

First Embodiment (1-1. Configuration of Keyboard Device)

FIG. 1 is a figure illustrating the configuration of a keyboard device according to a first embodiment. A keyboard device 1, in this example, is an electronic keyboard instrument that generates sounds according to the user's (player's) key depression, such as an electronic piano. Note that the keyboard device 1 may be a keyboard type controller that outputs control data (e.g., musical instrument digital interface (MIDI)) for controlling an external sound source device in accordance with key depression. In this case, the keyboard device 1 need not be provided with a sound source device.

The keyboard device 1 includes a keyboard assembly 10. The keyboard assembly 10 includes white keys 100*w* and black keys 100*b*. Pluralities of white keys 100*w* and black keys 100*b* are disposed in an aligned manner. The number of keys 100 is N, which in this example is 88. The direction in which the keys 100 are aligned is referred to as scale direction. When a description can be made without particularly discriminating the white key 100*w* and the black key 100*b* from each other, the white key 100*w* and the black key 100*b* may be referred to as the key 100. In the following description, a symbol followed finally by "w" means a component corresponding to the while key or keys. In addition, a symbol followed finally by "b" means a component corresponding to the black key or keys.

Part of the keyboard assembly 10 is present in the inside of a housing 90. When the keyboard device 1 is viewed from above, that part of the keyboard assembly 10 which is covered by the housing 90 is referred to as a non-external-appearance part NV, while that part of the keyboard assembly 10 which is exposed and visible from the user is referred to as an external appearance part PV. Specifically, the external appearance part PV refers to part of the keys 100, and is a region where the user can make a playing operation. Hereinafter, that part of the key 100 which is exposed as the external appearance part PV may be referred to as a key main body part.

Inside the housing 90 are disposed a sound source device 70 and a speaker 80. The sound source device 70 produces a sound waveform signal attendantly on depression of the key 100. The speaker 80 outputs the sound waveform signal produced in the sound source device 70 to an external space. Note that the keyboard device 1 may be provided with a slider for controlling volume of sound, a switch for changing-over tone, a display for displaying various kinds of information, etc.

Note that in the descriptions herein, the directions or sides such as the upper, lower, left, and right sides as well as the viewer's side and the depth side refer to the directions or sides in the case where the keyboard device 1 is viewed from the player when playing the keyboard device 1. Therefore, for example, the non-external-appearance part NV can be expressed to be located on the depth side as compared to the external appearance part PV. In addition, the directions or sides may be indicated with the key 100 as a reference, such as a key front end side (key front side) or a key rear end side (key rear side). In this case, the key front end side refers to the player's side of the keys 100 as viewed from the player. The key rear end side refers to the depth side of the keys 100 as viewed from the plyer. According to this definition, it is possible to express that a part ranging from the front end to the rear end of the key main body part of a black key 100*b* is a part projecting to the upper side as compared to the white keys 100*w*.

Figure 2:
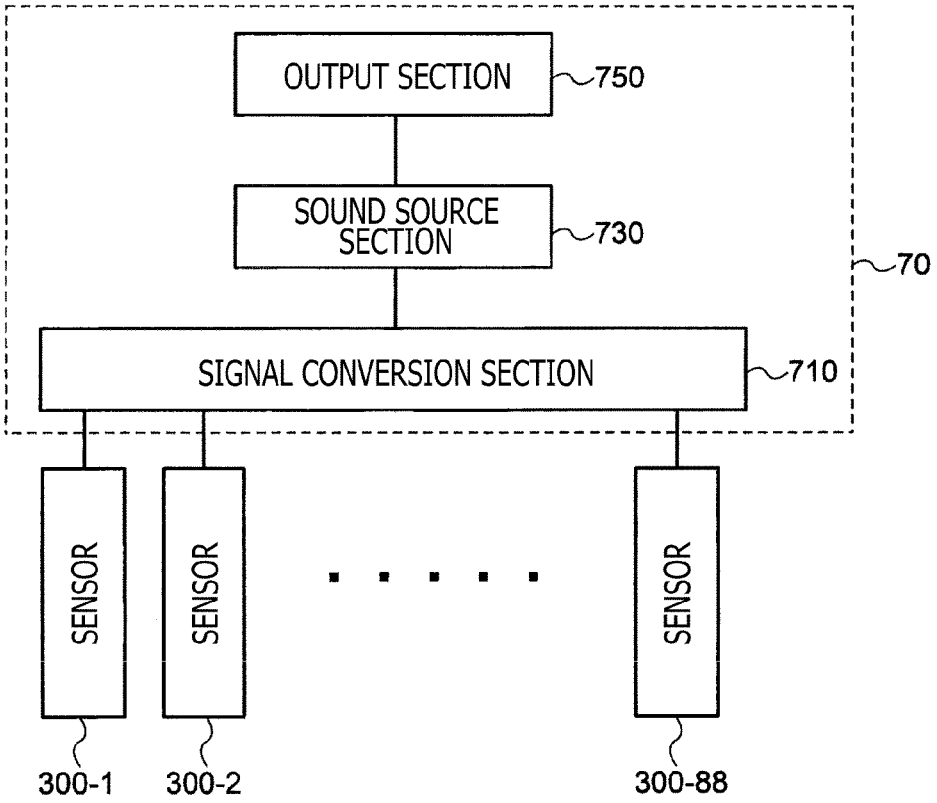
FIG. 2 is a block diagram depicting the configuration of a sound source device in the first embodiment.

FIG. 2 is a block diagram depicting the configuration of the sound source device according to the first embodiment. The sound source device 70 includes a signal conversion section 710, a sound source section 730, and an output section 750. Sensors 300 are provided correspondingly to the keys 100, respectively, and each detect an operation on the key and output a signal according to the contents of operation detected. In this example, the sensors 300 output signals according to three stages of key depression amounts. According to the interval of the signals, a key depression speed can be detected.

The signal conversion section 710 acquires output signals from the sensors 300 (sensors 300-1, 300-2, . . . , 300-88 corresponding to the 88 keys 100), and produces and outputs operation signals according to operated conditions of each of the keys 100. In this example, the operation signal is a MIDI format signal. Therefore, in accordance with a key depression operation or operations, the signal conversion section 710 outputs a note-on. In this instance, a key number of numbers indicating which one or ones of the 88 keys 100 are operated, and a velocity or velocities corresponding to the key depression speed or speeds are also outputted correspondingly to the note-on. On the other hand, according to a key release operation or operations, the signal conversion section 710 outputs a key number or numbers and a note-off correspondingly. A signal corresponding to other operation of a pedal or the like may be inputted to the signal conversion section 710, and be reflected on the operation signal.

The sound source section 730 produces a sound waveform signal or signals, based on the operation signal or signals outputted from the signal conversion section 710. The output section 750 outputs the sound waveform signal or signals produced by the sound source section 730. The sound waveform signal or signals are, for example, outputted to the speaker 80 or a sound waveform signal output terminal or the like. The configuration of the keyboard assembly 10 will be described below.

(1-2. Configuration of Keyboard Assembly)

Figure 3:
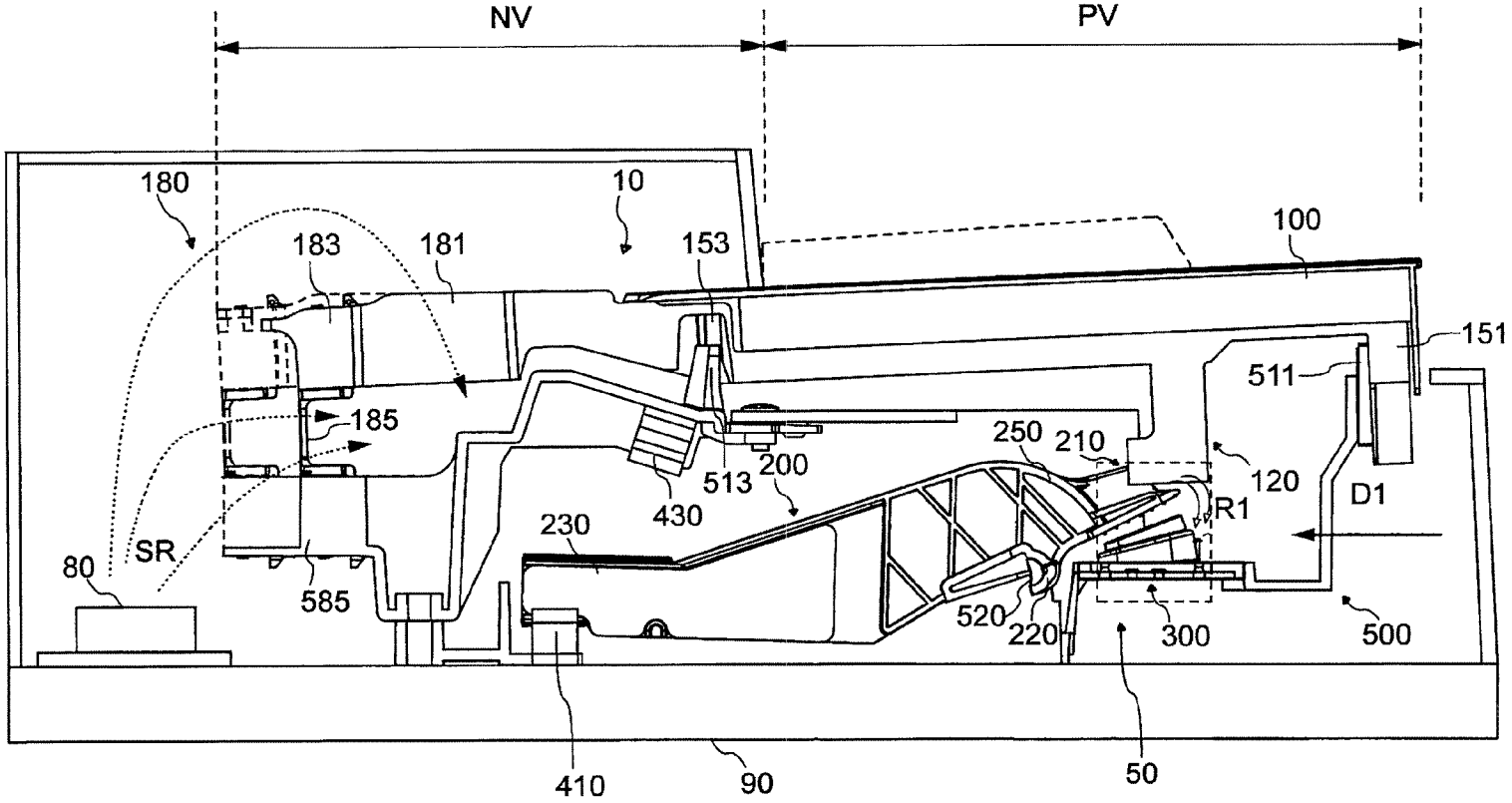
FIG. 3 is an illustration the configuration of the inside of a housing in the first embodiment, as viewed from a keyboard side surface.

FIG. 3 is an illustration of the configuration of the inside of the housing in the first embodiment, as viewed from the side of a keyboard side surface. As depicted in FIG. 3, the keyboard assembly 10 and the speaker 80 are disposed in the inside of the housing 90. In other words, the housing 90 covers at least part of the keyboard assembly 10 (a connection section 180 and a frame 500) and the speaker 80. The speaker 80 is disposed on the depth side of the keyboard assembly 10. The speaker 80 is disposed in such a manner as to output a sound according to key depression toward the upper side and the lower side. The sound outputted toward the lower side proceeds through the lower surface side of the housing 90 to the exterior. On the other hand, the sound outputted toward the upper side passes from the inside of the housing 90, through a space inside the keyboard assembly 10, and proceeds through gaps between the adjacent keys 100 in the external appearance part PV or through gaps between the keys 100 and the housing 90 to the exterior. Note that the route of the sound from the speaker 80 to reach the space inside the keyboard assembly 10 or the space on the lower side of the keys 100 (key main body parts) is exemplified as a route SR.

The keyboard assembly 10 includes the connection section 180, the hammer assembly 200 and the frame 500, in addition to the aforementioned keys 100. Most of the components of the keyboard assembly 10 are resin-made structures manufactured by injection molding or the like. The frame 500 is fixed to the housing 90. The connection section 180 connects the keys 100 rotatably relative to the frame 500. The connection section 180 includes a plate-shaped flexible member 181, a key-side support section 183, and a rod-shaped flexible member 185. The plate-shaped flexible member 181 extends from a rear end of the key 100. The key-side support section 183 extends from a rear end of the plate-shaped flexible member 181. The rod-shaped flexible member 185 is supported by the key-side support section 183 and a frame-side support section 585 of the frame 500. In other words, the rod-shaped flexible member 185 is disposed between the key 100 and the frame 500. With the rod-shaped flexible member 185 bent, the key 100 can be rotated relative to the frame 500. The rod-shaped flexible member 185 is attachable to and detachable from the key-side support section 183 and the frame-side support section 585. Note that the rod-shaped flexible member 185 may be united to the key-side support section 183 and the frame-side support section 585, or may be joined to them by adhesion or the like, so as not to be detachably attached.

The key 100 includes a front end key guide 151 and a side surface key guide 153. The front end key guide 151 is in slidable contact with a front end frame guide 511 of the frame 500 in a state of covering the front end frame guide 511. The front end key guide 151 is in contact with the front end frame guide 511 on both sides in regard of the scale direction of an upper portion and a lower portion thereof. The side surface key guide 153 is in slidable contact with a side surface frame guide 513 on both sides in regard of the scale direction. In this example, the side surface key guide 153 is disposed in a region of a side surface of the key 100 which region corresponds to the non-external-appearance part NV, and is present on the key front end side as compared to the connection section 180 (the plate-shaped flexible member 181), but it may be disposed in a region corresponding to the external appearance part PV.

In addition, a key-side load section 120 is connected to the key 100 on the lower side of the external appearance part PV. The key-side load section 120 is connected to the hammer assembly 200 in such a manner as to rotate the hammer assembly 200 when the key 100 is rotated.

The hammer assembly 200 is disposed in a space on the lower side of the key 100, and is rotatably attached to the frame 500. The hammer assembly 200 includes a weight section 230 and a hammer main body part 250. At the hammer main body part 250, a shaft support section 220 serving as a bearing for a rotary shaft 520 of the frame 500 is disposed. The shaft support section 220 and the rotary shaft 520 of the frame 500 makes slidable contact with each other at at least three points.

A hammer-side load section 210 is connected to a front end portion of the hammer main body part 250. The hammer-side load section 210 includes a part which internally makes contact with the key-side load section 120 in such a manner as to be slidable substantially in the front-rear direction. A lubricating material such as grease may be disposed on this contact part. The hammer-side load section 210 and the key-side load section 120 (in the following description, they may be collectively referred to as "the load generation section") slide on each other, to generate part of a load at the time of key depression. The load generation section, in this example, is located on the lower side of the key 100 in the external appearance part PV (on the front side as compared to the rear end of the key main body part).

The weight section 230 includes a metallic weight, and is connected to a rear end portion (on the depth side as compared to the rotary shaft) of the hammer main body part 250. At normal time (when key depression is not made), the weight section 230 is in a state of being placed on a lower-side stopper 410. This causes the key 100 to be stabilized at a rest position. When key depression is made, the weight section 230 is moved upward, to collide on an upper-side stopper 430. By this, an end position where a maximum key depression amount of the key 100 is reached is defined. The weight section 230 also gives a load to key depression. The lower-side stopper 410 and the upper-side stopper 430 are formed using a shock-absorbing material or the like (nonwoven fabric, elastic material or the like).

On the lower side of the load generation section, the sensors 300 are mounted to the frame 500. When the sensor 300 is crushed on the contact surface 215 side of the hammer-side load section 210 by key depression, the sensor 300 outputs a detection signal. Here, the hammer-side load section 210, the key-side load section 120, and the sensor 300 are together referred to as a switching device 50. The configuration of the switching device 50 will be described in detail below.

(1-3. Configuration of Switching Device)

Figure 4:
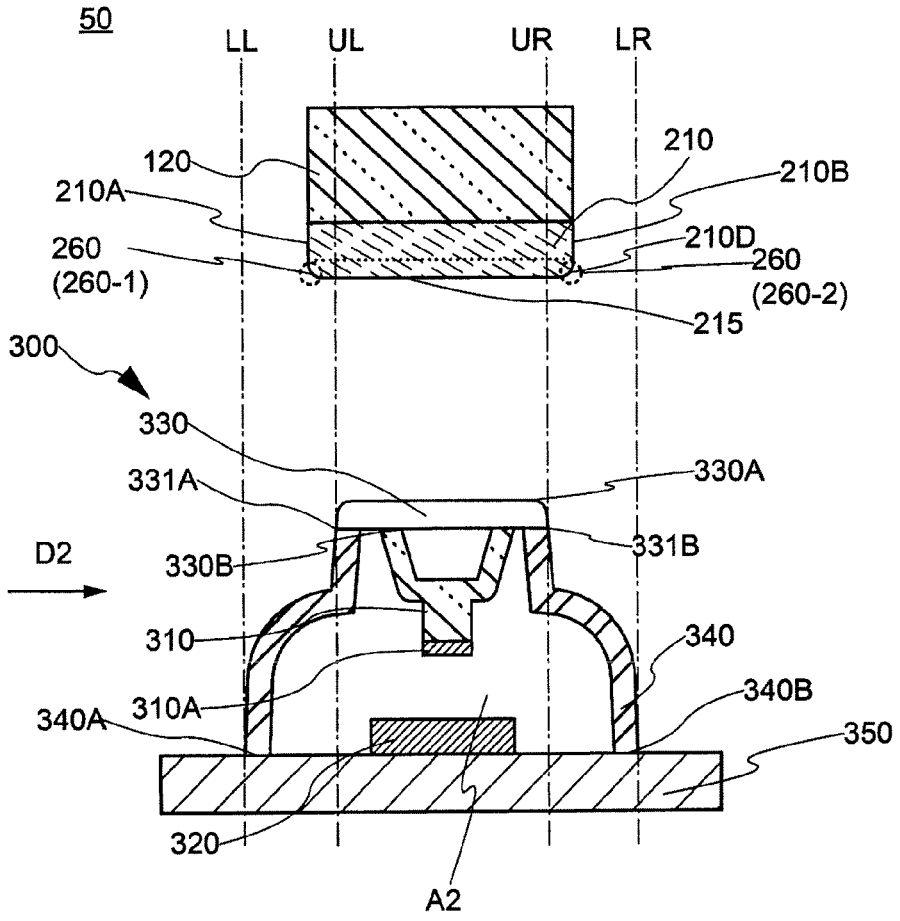
FIG. 4 is an illustration of a switching device as viewed from a key front end side in the first embodiment.

FIG. 4 depicts a sectional view of the switching device 50 as viewed from the key front end side (key front side), or in a direction D1. Note that the D1 direction may be referred to as an extending direction of the hammer-side load section 210, or a direction perpendicular to the rotary shaft 520 (the direction in which the rotary shaft 520 extends) and parallel to a lower electrode support section 350. In addition, the D1 direction can be said to be a direction which is perpendicular to the direction of arrangement of the plurality of keys (scale direction) and which is parallel to an upper surface of the lower electrode support section 350.

The sensor 300 includes an upper electrode 310, a lower electrode 320, an upper electrode support section 330 (an example of an upper surface section), a deformation section 340, and the lower electrode support section 350 (an example of a support member).

The upper electrode 310 is provided at a lower surface 330B of the upper electrode support section 330. The upper electrode 310 is formed using an elastic material, and is provided at a tip portion 310A thereof with a conductive part. In this example, a molded silicone rubber is used for the upper electrode 310, and conductive carbon black is used as a conductive material at the tip portion 310A.

The lower electrode 320 is disposed on the upper surface side of the lower electrode support section 350 in such a manner as to face the upper electrode 310. The lower electrode 320 includes a conductive material. For example, a metallic material such as gold, silver, copper, and platinum or a conductive resin such as a resin containing conductive carbon black is used for the lower electrode 320.

The deformation section 340 is disposed such as to interconnect the upper electrode support section 330 and the lower electrode support section 350. The deformation section 340 is connected to an end portion 331A of the upper electrode support section 330 and an end portion 331B of the upper electrode support section 330. The end portion 331A is an end portion on one side in regard of the extending direction of the rotary shaft 520, of the upper electrode support section 330 (in FIG. 4, an end portion on the left side of the upper electrode support section 330), and the end portion 331B is an end portion on the other side in regard of the extending direction of the rotary shaft 520 (an end portion on the right side of the upper electrode support section 330). In other words, the end portion 331A is an end portion (first end portion) on one side in regard of the direction of arrangement of the plurality of keys (scale direction), of the upper electrode support section 330, and the end portion 331B is an end portion (second end portion) on the other side in regard of the direction of arrangement of the plurality of keys, of the upper electrode support section 330. Note that when a description can be made without distinction between the end portion 331A and the end portion 331B, the end portion may be referred to as the end portion 331. In addition, the deformation section 340 may be fixed directly or indirectly to the lower electrode support section 350. In this example, the deformation section 340 is fixed to the lower electrode support section 350 at a connection portion 340A and a connection portion 340B. The connection portion 340A is a portion of the deformation section 340 that is fixed to the lower electrode support section 350, and is an end portion on one side in regard of the extending direction of the rotary shaft 520 (in FIG. 4, an end portion on the left side of the deformation section 340). On the other hand, the connection portion 340B is a portion of the deformation section 340 that is fixed to the lower end support section 350, and is an end portion on the other side in regard of the extending direction of the rotary shaft 520 (an end portion on the right side of the deformation section 340). In other words, the connection portion 340A is an end portion (first end portion) on one side in regard of the direction of arrangement of the plurality of keys (scale direction), of the deformation section 340, and the connection portion 340B is an end portion (second end portion) on the other side in regard of the direction of arrangement of the plurality of keys, of the deformation section 340. In this instance, the connection portion 340A is disposed outside of and below the end portion 331A of the upper electrode support section 330, so that it can be said that the deformation section 340 is disposed in such a manner as to intersect the connection portion 340A and the end portion 331A of the upper electrode support section 330. Note that in the case where the deformation section 340 is fixed to other member, it may not necessarily be fixed to the lower electrode support section 350. The deformation section 340 has a function of deforming, by making the upper electrode 310 and the upper electrode support section 330 movable in the vertical direction, such that the distance between the upper electrode 310 and the lower electrode 320 is variable and it can be restored into its original position. Therefore, as the deformation section 340, a deformable and restorable member is used. For example, a molded silicone rubber is used as the deformation section 340.

The upper electrode support section 330 is disposed opposite to the hammer-side load section 210. In FIG. 4, an upper surface 330A of the upper electrode support section 330 has a flat surface. Note that the upper surface 330A may have a recess according to the shape of the upper electrode 310. For the upper electrode support section 330, a silicone rubber is used such that it can be molded to be integral with the upper electrode 310 and the deformation section 340. Therefore, the upper electrode 310, the upper electrode support section 330, and the deformation section 340 can together be referred to as a contact member. When the term of the contact member is used, the upper electrode support section 330 may be referred to as an upper surface section of the contact member. In addition, in the aforementioned shape, the contact member has a shape of rising from the connection portion 340A and the connection portion 340B. Therefore, the connection portion 340A can be called a rising portion of the contact member. The connection portion 340B is disposed similarly. In addition, a lubricating material may be provided on the upper electrode support section 330.

The lower electrode support section 350 may be provided as another member, together with the lower electrode 320. For example, the lower electrode support section 350 may be provided as a printed circuit board, and the lower electrode 320 may be an electrode formed on the printed circuit board. The lower electrode support section 350 can be said to be a support member. In short, the lower electrode 320 and the lower electrode support section 350 can together be called a circuit board.

In the foregoing, the upper electrode support section 330, the lower electrode support section 350, and the deformation section 340 form a surrounded region A2. In this instance, the upper electrode 310 and the lower electrode 320 can be said to be disposed in the region A2.

The hammer-side load section 210 has a contact surface 215 that makes contact with the upper electrode support section 330. The contact surface 215 has a flat surface. In addition, the hammer-side load section 210 has a chamfer portion 260-1 disposed such as to interconnect the contact surface 215 and a side surface 210A, at an end portion 210D. Similarly, the hammer-side load section 210 has a chamfer portion 260-2 disposed such as to interconnect the contact surface 215 and a side surface 210B. The chamfer portions 260-1 and 260-2 are portions that are formed at connection portions between the contact surface 215 and the side surfaces 210A and 210B and do not have an angular portion. Besides, the chamfer portions 260-1 and 260-2 may be formed at connection portions between the flat surface of the contact surface 215 and the side surfaces 210A and 210B. In addition, since the chamfer portions 260-1 and 260-2 are formed at the connection portions between the contact surface 215 and the side surfaces 210A and 210B, the chamfer portion 260-1 can be said to be that one of the two end portions of the contact surface 215 which is nearer to the side surface 210A, whereas the chamfer portion 260-2 can be said to be that one of the two end portions of the contact surface 215 which is nearer to the side surface 210B. Considering in this way, it can be said that the position of the chamfer portion 260-1 is substantially the same as the position of an end portion on one side in regard of the extending direction of the rotary shaft 520 (in FIG. 4, an end portion on the left side of the contact surface 215), of the contact surface 215, and the position of the side surface 210B is substantially the same as the position of an end portion on the other side in regard of the extending direction of the rotary shaft 520 (an end portion on the right side of the contact surface 215), of the contact surface 215. Besides, in other words, it can be said that the position of the chamfer portion 260-1 is substantially the same as the position of an end portion (first end portion) on one side in regard of the direction of arrangement of the plurality of keys (scale direction), of the contact surface 215, and the position of the chamfer portion 260-2 is substantially the same as the position of an end portion (second end portion) on the other side in regard of the direction of arrangement of the plurality of keys. When such an expression is used, it can be said that the chamfer portion 260-1 is located on the left side of the end portion 331A (on the outer side of the end portion 331A) and on the right side of the connection portion 340A (on the inner side of the connection portion 340A), whereas the chamfer portion 260-2 is located on the right side of the end portion 331B (on the outer side of the end portion 331B) and on the left side of the connection portion 340B (on the inner side of the connection portion 340B). Note that when a description can be made without distinction between the chamfer portion 260-1 and the chamfer portion 260-2, the chamfer portion may be referred to as the chamfer portion 260. For the hammer-side load section 210 including the contact surface 215, a material more rigid than the upper electrode support section 330 is used. For example, such a material as plastic is used for the hammer-side load section 210. A lubricating material may be provided on the contact surface 215.

The chamfer portion 260 has a tangential shape. The tangential shape means a shape which, for example, in a sectional view, transits continuously from a straight line to a circular arc and, further, from the circular arc to a straight line, without having any angle. Therefore, the hammer-side load section 210 can have a smooth shape, without having a pointed shape at an end portion of the contact surface.

Here, in FIG. 4, a virtual plane which contains the end portion 331A of the upper electrode support section 330 and which is perpendicular to the upper surface 330A of the upper electrode support section 330 is referred to as plane UL. In addition, a virtual plane which contains the connection portion 340A of the deformation section 340 for connection with the lower electrode support section 350 and which is perpendicular to the upper surface 330A of the upper electrode support section 330 is referred to as plane LL. In this instance, the chamfer portion 260-1 is provided between the plane UL and the plane LL. Similarly, a virtual plane which contains the end portion 331B of the upper electrode support section 330 and which is perpendicular to the upper surface 330A of the upper electrode support section 330 is referred to as plane UR. Besides, a virtual plane which contains the connection portion 340B of the deformation section 340 for connection with the lower electrode support section 350 and which is perpendicular to the upper surface 330A of the upper electrode support section 330 is referred to as plane LR. In this instance, the chamfer portion 260-2 is provided between the plane UR and the plane LR. Note that, in other words, the plane UL is a virtual plane which contains the end portion 331A of the upper electrode support section 330 and which is perpendicular to the extending direction of the rotary shaft 520, while the plane LL is a virtual plane which contains the connection portion 340A of the deformation section 340 for connection with the lower electrode support section 350 and which is perpendicular to the extending direction of the rotary shaft 520. In addition, the plane UR is a virtual plane which contains the end portion 331B of the upper electrode support section 330 and which is perpendicular to the extending direction of the rotary shaft 520, whereas the plane LR is a virtual plane which contains the connection portion 340B of the deformation section 340 for connection with the lower electrode support section 350 and which is perpendicular to the extending direction of the rotary shaft 520.

Figure 5:
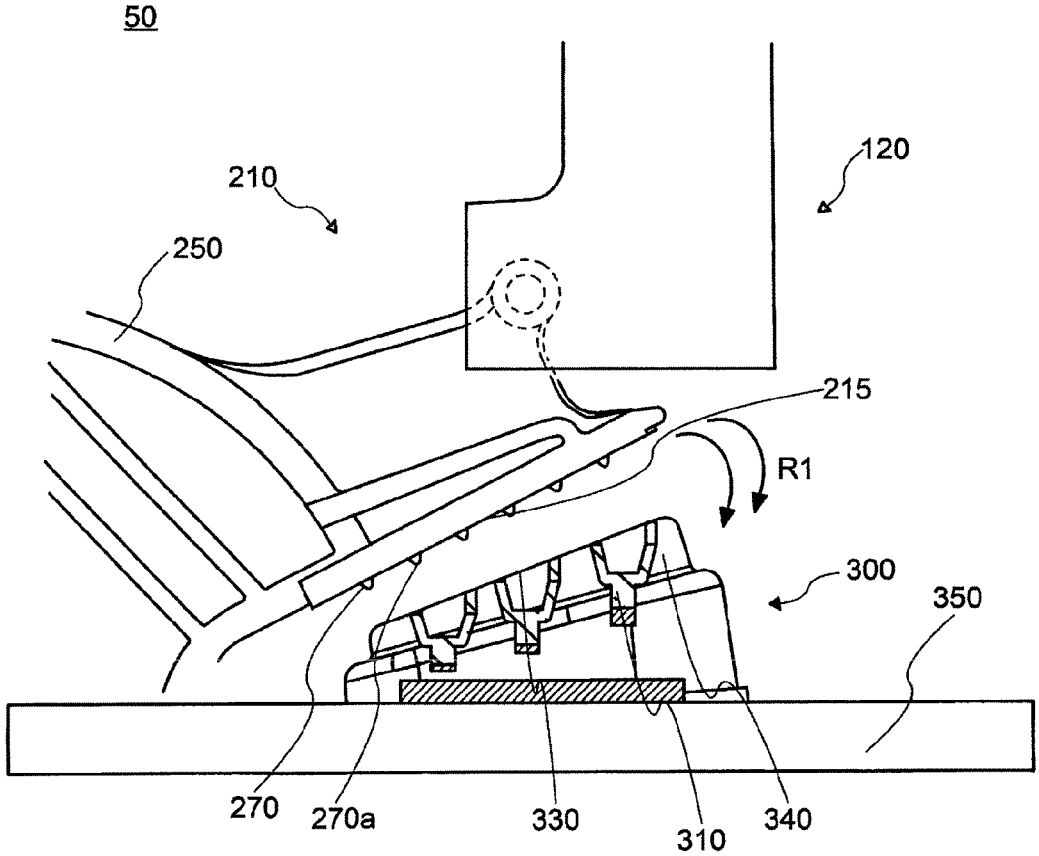
FIG. 5 is an illustration of the switching device as viewed from a key side surface in the first embodiment.

FIG. 5 depicts a sectional view when the switching device 50 of FIG. 3 is viewed from a lateral direction relative to the keyboard (in the scale direction, D2 direction in FIG. 4). As depicted in FIG. 5, the upper electrode support section 330 of the sensor 300 is disposed in an inclined state relative to the lower electrode support section 350 in accordance with a trajectory R1 along which the hammer-side load section 210 is rotated.

The contact surface 215 is provided with a plurality of projections 270. The projection 270 is rounded at its tip portion 270*a*. Note that the projection 270 may be rounded not only at its tip portion 270*a* but also at its side surface. For example, the projection 270 may have a semicircular shape.

Figure 6:
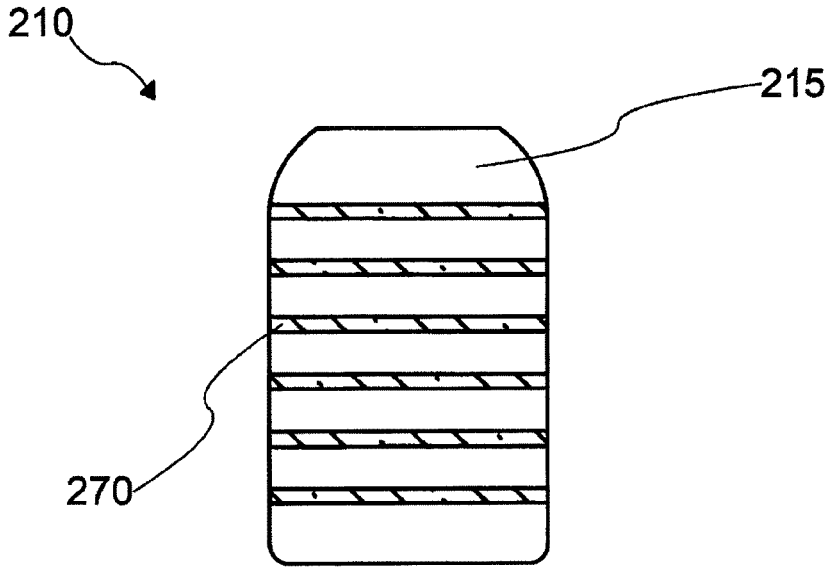
FIG. 6 is an illustration of a contact surface of a hammer-side load section as viewed from a key lower surface in the first embodiment.

FIG. 6 depicts a figure depicting the contact surface of the hammer-side load section 210 as viewed from the key lower side. The plurality of projections 270 are arranged in parallel to one another.

(1-4. Action of Keyboard Assembly)

Figure 7A:
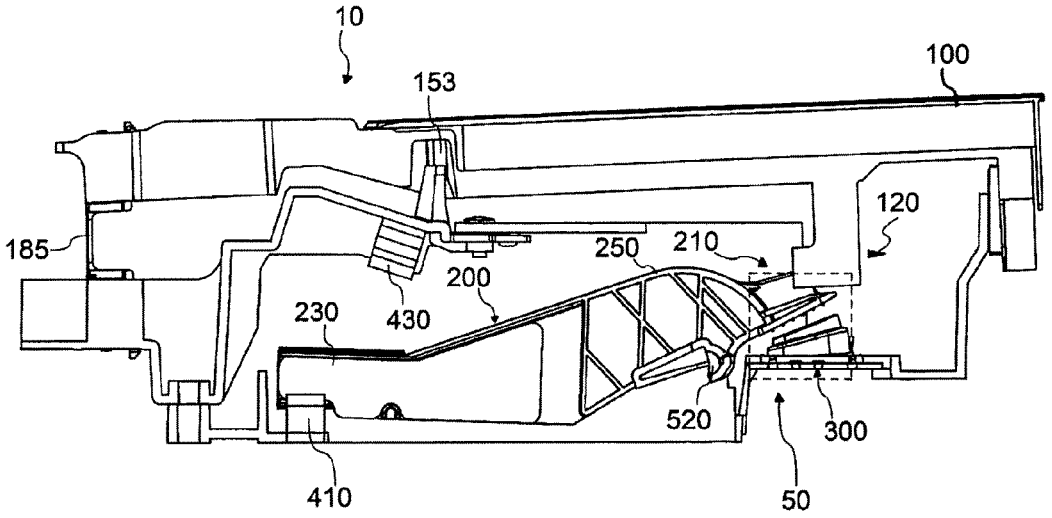
FIGS. 7A and 7B are figures illustrating an action of a key assembly when a key (white key) in the first embodiment is depressed.
Figure 7B:
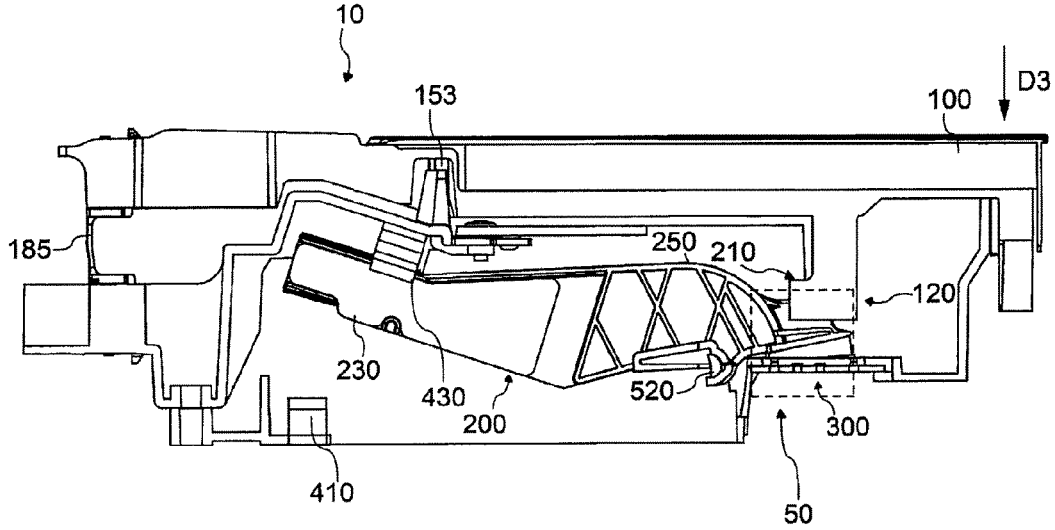

FIGS. 7A and 7B are figures for explaining an action of the keyboard assembly when a key (white key) in the first embodiment is depressed. FIG. 7A is a figure in the case where the key 100 is at a rest position (a state in which key depression is not being made). FIG. 7B is a figure in the case where the key 100 is at an end position (a state in which the key is depressed to a final point). When the key 100 is depressed, bending occurs with the rod-shaped flexible member 185 as a center of rotation. In this instance, though bending of the rod-shaped flexible member 185 toward the front side (player's side) of the key 100 is generated, the key 100 is not moved toward the front side but is rotated in the direction (D3 direction) perpendicular to the key 100, since its movement in the front-rear direction is restricted by the side surface key guide 153. Then, the key-side load section 120 pushes down the hammer-side load section 210, whereby the hammer assembly 200 is rotated with the rotary shaft 520 as a center. Note that in the description of FIGS. 7A and 7B, for the components of the switching device 50, reference is made to FIGS. 4 and 5.

With the weight section 230 colliding on the upper-side stopper 430, rotation of the hammer assembly 200 is stopped, and the key 100 reaches the end position. In addition, when the sensor 300 is crushed by the hammer-side load section 210, the sensor 300 outputs detection signals at a plurality of stages of crushing amounts (key depression amounts). In this case, the hammer-side load section 210 functions as one of actuators. Note that a sectional view of the switching device 50 as viewed from the key tip direction is depicted in FIG. 8.

Figure 8:
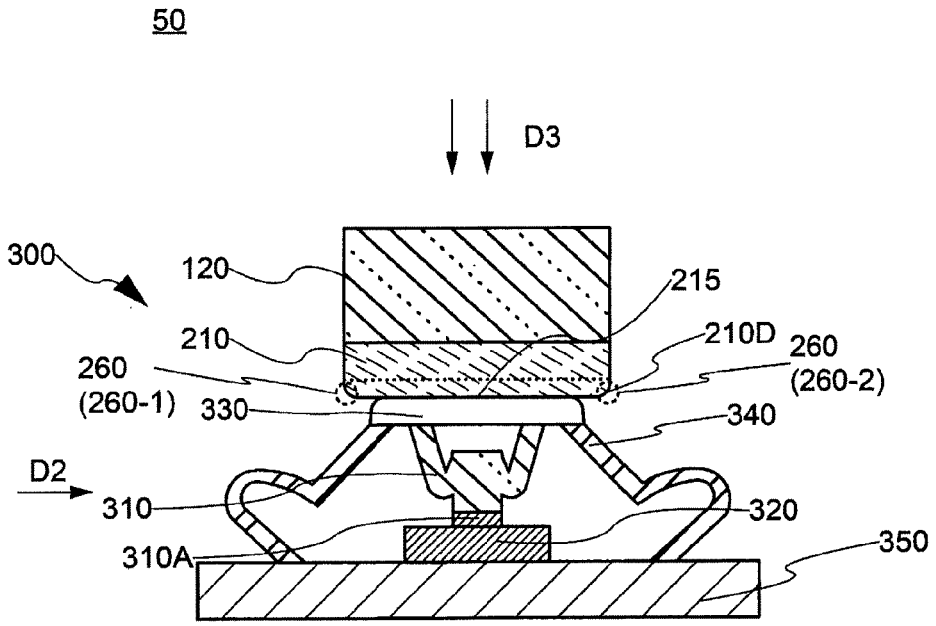
FIG. 8 is an illustration of the switching device in the first embodiment.
Figure 14:
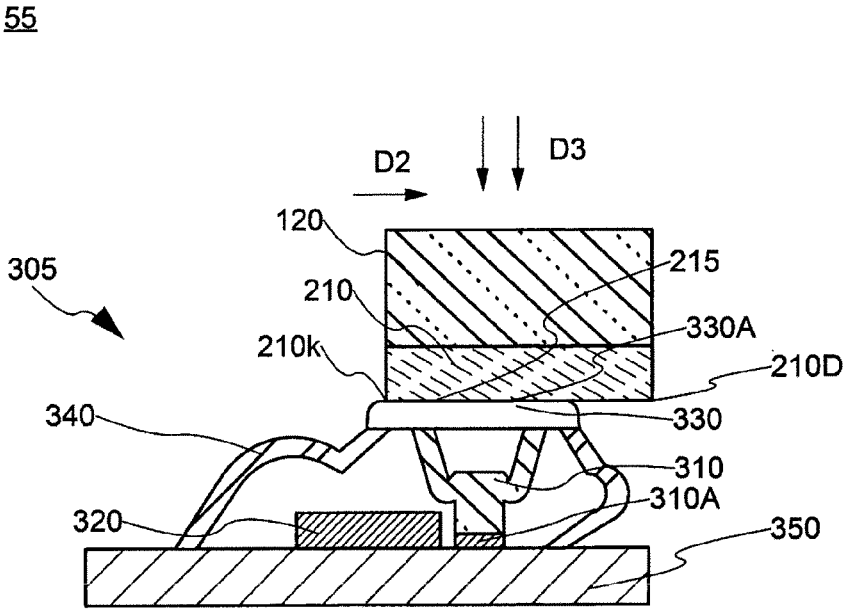
FIG. 14 is an illustration of a switching device in the related art.

As depicted in FIG. 8, in the case where the upper electrode support section 330 in the sensor 300 is depressed in the direction (D3 direction) perpendicular to the lower electrode support section 350 by the hammer-side load section 210, the upper electrode 310 and the lower electrode 320 make contact with each other. In this case, the detection signals are normally outputted in the switching device 50, and, therefore, a stable sound is generated. However, for example, in the case where a key located far from the player is depressed or where vibration (fluctuation) is generated in the hammer-side load section 210, a force in the scale direction (D2 direction), for example, may act on the hammer-side load section 210. FIG. 14 depicts a sectional view in the case where a force in the scale direction (D2 direction) is exerted in the related art example.

As depicted in FIG. 14, a switching device 55 in the related art example has a configuration in which the width of a contact surface 215 of a hammer-side load section 210 is comparable to the width of an upper surface 330A of an upper electrode support section 330 or is large, and an end portion 210D of the hammer-side load section 210 has an angle 210*k*. When the hammer-side load section 210 is depressed in the vertical direction (D3 direction) in a state in which a force in the scale direction (D2 direction) is also exerted, it makes contact with the upper electrode support section 330 in a deviated manner. In this case, the angle 210*k* bites into part of the upper surface 330A of the upper electrode support section 330, and catching is generated. As a result, the upper electrode support section 330 would be moved following up to the movement of the hammer-side load section 210. Further, the deformation section 340 connected to the upper electrode support section 330 is deformed in accordance with the upper electrode support section 330. In this case, as depicted in FIG. 14, it is difficult to electrical connect between the upper electrode 310 and the lower electrode 320. In the case where it may be impossible to electrical connect between the upper electrode 310 and the lower electrode 320, the sensor 305 is not output detection signals, and, therefore, the keyboard device 1 is not generate a sound. In addition, even if the upper electrode 310 and the lower electrode 320 are partly connected to each other, a stable connection is not secured, and, therefore, the keyboard device 1 is not generate a sound stably.

Figure 15:
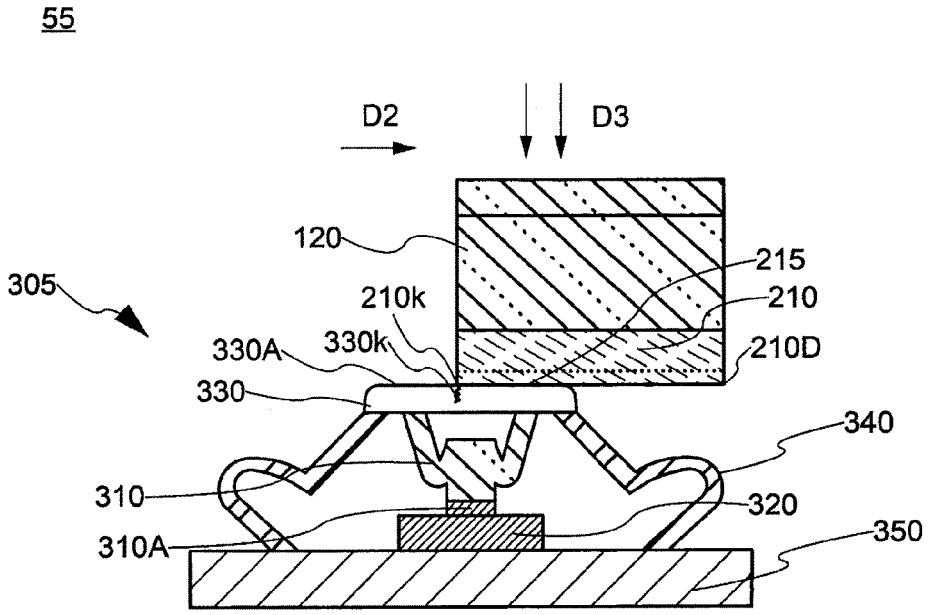
FIG. 15 is another illustration of a switching device in the related art.

In addition, even if the biting-in of the angle 210*k* into the upper electrode support section 330 is weak and the hammer-side load section 210 is moved with deviation from the upper electrode support section 330, the angle 210*k* would give a strong shock to the upper surface 330A of the upper electrode support section 330, possibly causing a loss 330*k* in the upper electrode support section 330, as depicted in FIG. 15. Examples of the loss 330*k* in this case include a crack or a hole generated in the upper electrode support section 330. Therefore, in the case where an end portion 210D of the contact surface 215 of the hammer-side load section 210 in the switching device 55 according to the related art has the angle 210*k*, there arises a need to further enlarge the width of the hammer-side load section 210 relative to the upper electrode support section 330, taking into account the depression with deviation (for example, a need to dispose the end portion 210D of the hammer-side load section 210 in FIG. 4 to the outer side of LL and LR). This may cause interference with other keys, which is undesirable in designing the keyboard device 1.

Figure 9:
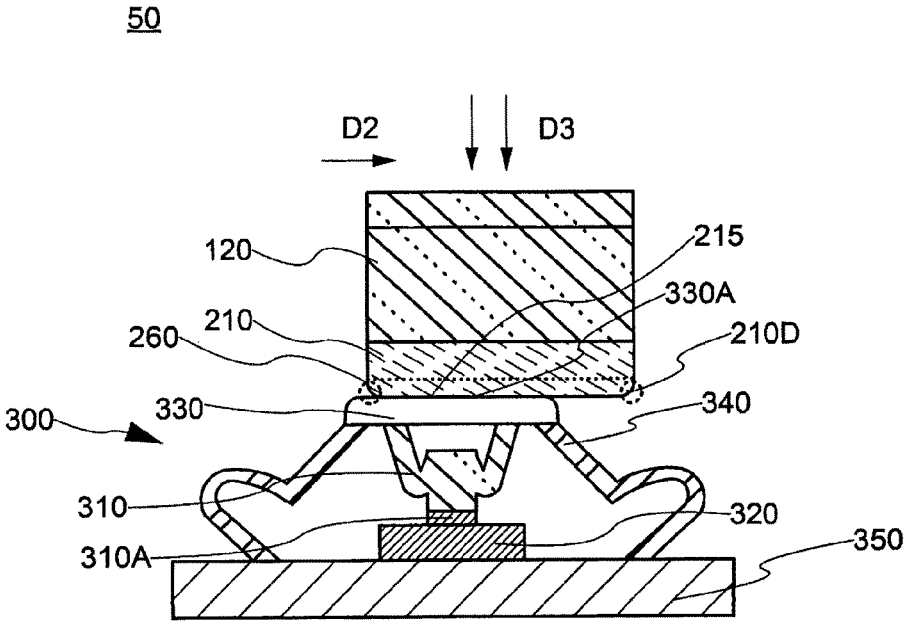
FIG. 9 is another illustration of the switching device in the first embodiment.

FIG. 9 depicts a sectional view of the sensor 300 as viewed from the key tip direction, when the upper electrode support section 330, in use of the present embodiment, makes contact with the contact surface 215 of the hammer-side load section 210 and is depressed. In the case where the present embodiment is used, the hammer-side load section 210 has only a flat portion in a region ranging from the end portion 331A to the end portion 331B of the upper electrode support section 330. In addition, the hammer-side load section 210 has the chamfer portion 260, and the chamfer portion 260 has a tangential shape. This ensures that since the hammer-side load section 210 does not have any angle 210*k*, even when the hammer-side load section 210 makes contact with the upper surface 330A of the upper electrode support section 330 with a deviation, biting-in and catching due to the angle 210*k* would not be generated. Therefore, the upper electrode support section 330 is prevented from following up to a movement of the hammer-side load section 210, and the hammer-side load section 210 can be smoothly deviated (moved) in the scale direction.

In addition, as depicted in FIG. 4, the chamfer portion 260-1 of the contact surface 215 of the hammer-side load section 210 is located between the plane UL and the plane LL, whereas the chamfer portion 260-2 is located between the plane UR and the plane LR. Therefore, there is no need to further enlarge the width of the hammer-side load section 210 relative to the upper electrode support section 330, taking into account the deviation, and, therefore, the degree of freedom in designing the keyboard device 1 is not narrowed.

Besides, in this instance, since the hammer-side load section 210 has the chamfer portions 260, contact of the angle 210*k* depicted in FIG. 15 with the upper surface 330A of the upper electrode support section 330 is avoided, and, therefore, damaging of the upper electrode support section 330 is prevented.

Further, as depicted in FIG. 5, the contact surface 215 of the hammer-side load section 210 is provided with the plurality of projections 270. This reduces the area of contact between the contact surface 215 and the upper surface 330A of the upper electrode support section 330. In this case, even if a cohesive (bonding) force or a static frictional force acts between the projections 270 of the contact surface 215 of the hammer-side load section 210 and the upper surface 330A of the upper electrode support section 330, forces exerted in the vertical direction (D3 direction) and the scale direction (D2 direction) are greater than the cohesive force or the static frictional force. As a result, the hammer-side load section 210 can be deviated (moved) from the upper electrode support section 330. In other words, the upper electrode support section 330 is prevented from following up to the movement of the hammer-side load section 210 as depicted in FIG. 14, and the hammer-side load section 210 can be smoothly deviated in the scale direction. As a result, since the upper electrode support section 330 is prevented from following up to the deviation of the hammer-side load section 210 in the scale direction (D2), the influence of the upper electrode support section 330 on the movement of the hammer-side load section 210 in the scale direction (D2) is mitigated, and the upper electrode 310 disposed on the upper electrode support section 330 can also keep a predetermined position. Accordingly, as depicted in FIG. 9, when the upper electrode support section 330 is depressed by the hammer-side load section 210, the upper electrode 310 and the lower electrode 320 can make contact with each other assuredly. In other words, the keyboard device 1 can generate a sound stably.

Second Embodiment (2. Configuration of Switching Device 50*a*)

In a second embodiment, a switching device 50*a* having a structure different from that in the first embodiment will be described.

Figure 10:
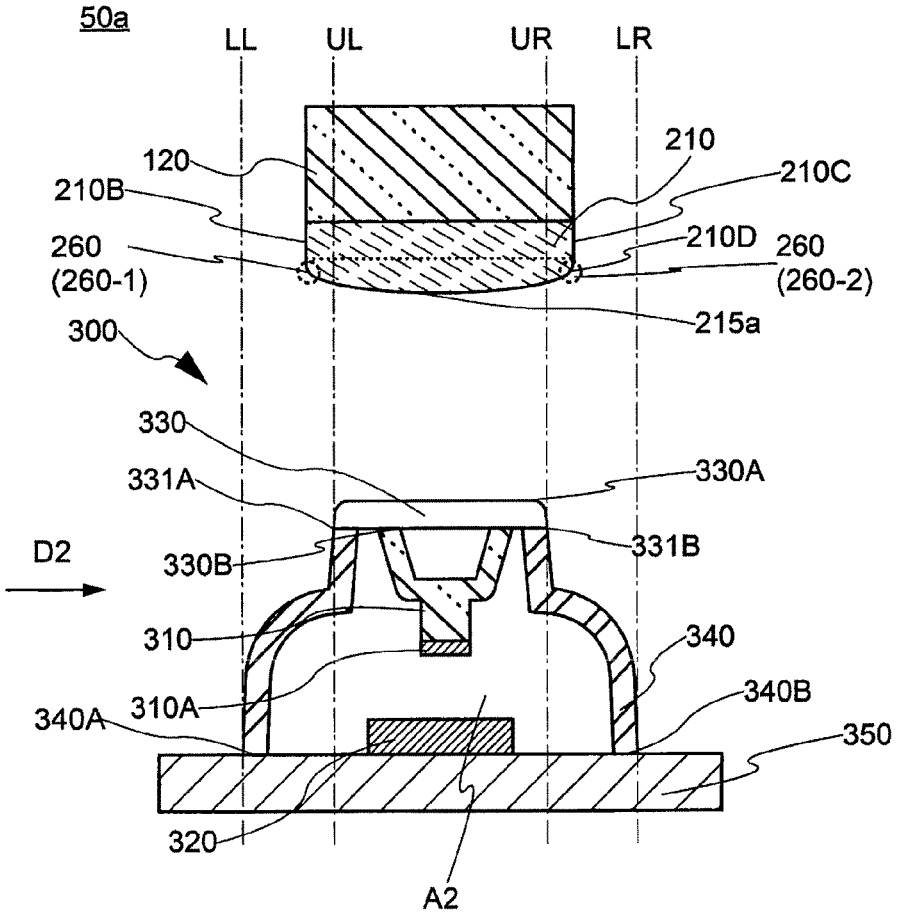
FIG. 10 is an illustration of a switching device in a second embodiment.

FIG. 10 depicts a sectional view of the switching device 50*a*. As depicted in FIG. 10, a contact surface 215*a* of a hammer-side load section 210 has a curved surface.

Figure 11:
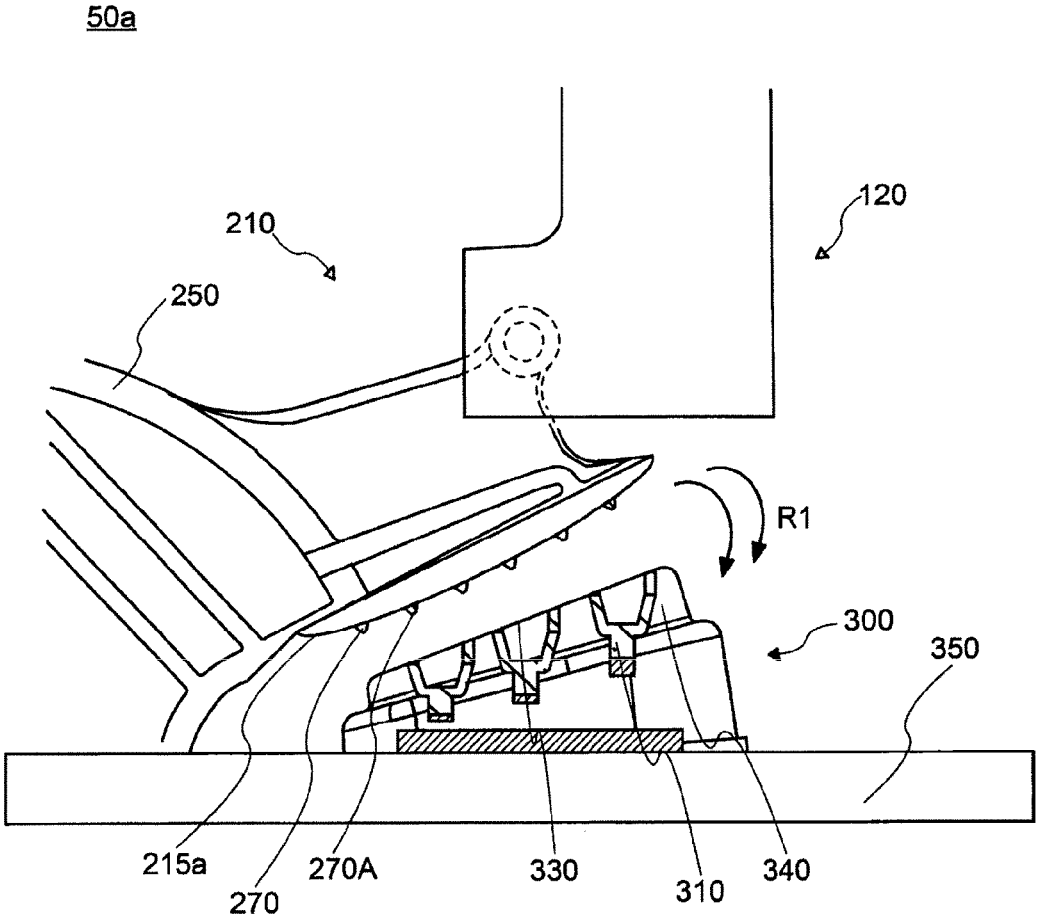
FIG. 11 is an illustration of the switching device in the second embodiment, as viewed from a key side surface.

FIG. 11 depicts a sectional view of the switching device 50*a* of FIG. 10, as viewed from a lateral direction relative to a keyboard (scale direction, D2 direction in FIG. 10). As depicted in FIG. 11, in the sectional view taken in the direction of D2, also, the contact surface 215*a* of the hammer-side load section 210 has a curved surface similarly. Since the contact surface 215*a* has the curved surface, an end portion 210D is in a state of being spaced from an upper surface 330A of an upper electrode support section 330, as compared to the case of the switching device 50. As a result, biting-in of the end portion 210D of the hammer-side load section 210 into the upper electrode support section 330 or the resultant catching is restrained more effectively. In addition, the area of contact between the contact surface 215*a* of the hammer-side load section 210 and the upper surface 330A of the upper electrode support section 330 can be reduced. As a result, the hammer-side load section 210 can be moved smoothly, and an upper electrode 310 is prevented from being deviated from a lower electrode 320. Therefore, defective detection in a sensor 300 is prevented. In other words, a keyboard device 1 can generate a sound stably.

Note that while the contact surface 215*a* of the hammer-side load section 210 has a curved surface as viewed from the key front end side and as viewed in the scale direction in the switching device 50*a*, the contact surface 215*a* may have a curved surface only when viewed in one direction.

Third Embodiment (3. Configuration of Switching Device 50*b*)

In a third embodiment, a switching device 50*b* having a structure different from that in the first embodiment will be described.

Figure 12:
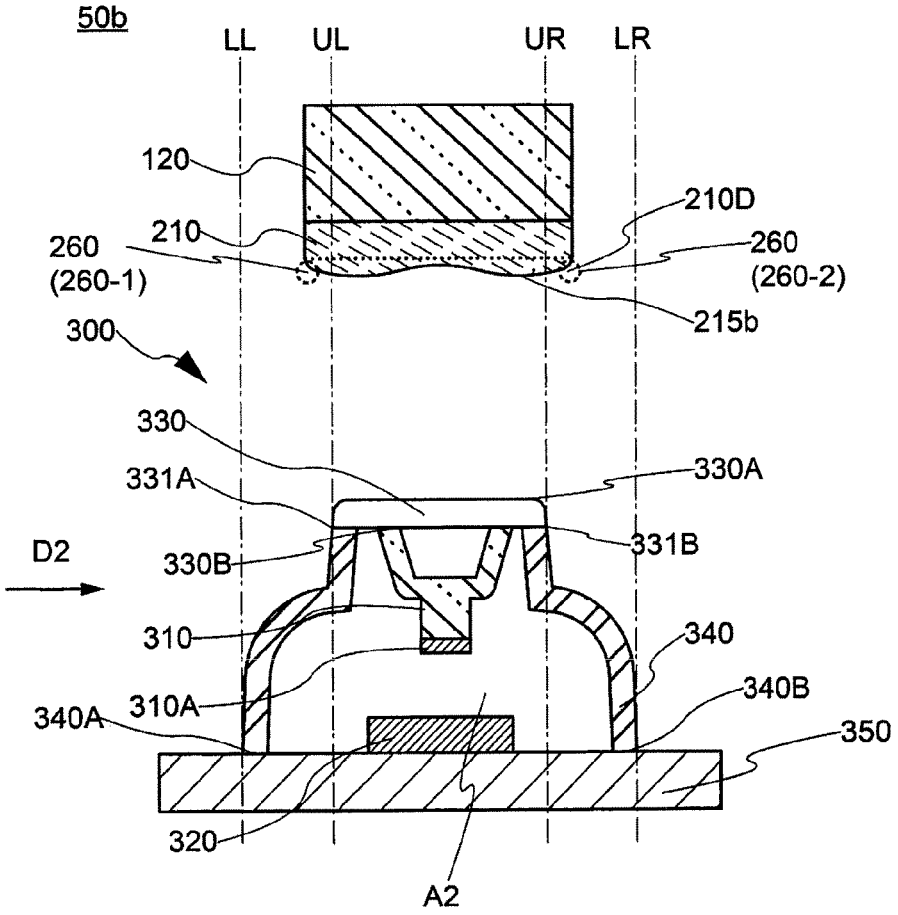
FIG. 12 is an illustration of a switching device in a third embodiment.

FIG. 12 depicts a sectional view of the switching device 50*b*. As depicted in FIG. 12, a contact surface 215*b* of a hammer-side load section 210 has a rugged shape (projected and recessed shape) as viewed from a key front end direction (D1 direction in FIG. 3). This shape ensures that like in the case of the switching device 50*a*, an end portion 210D is in a state of being spaced from an upper surface 330A of an upper electrode support section 330, as compared to the case of the switching device 50. As a result, biting-in of the end portion 210D of the hammer-side load section 210 into the upper electrode support section 330 or the resultant catching is restrained more effectively. In addition, the area of contact between a contact surface 215*b* of the hammer-side load section 210 and the upper surface 330A of the upper electrode support section 330 can be further reduced, as compared to the case of the switching device 50. As a result, an upper electrode 310 is prevented from being deviated due to cohesion or friction between the contact surface 215*b* of the hammer-side load section 210 and the upper surface 330A of the upper electrode support section 330. Therefore, defective detection in a sensor 300 is prevented. In other words, a keyboard device 1 can generate a sound stably.

<Modification>

While the embodiments of the present disclosure have been described above, the present disclosure may be carried out in various modes as follows.

While an example in which the hammer-side load section 210 makes contact with the upper electrode support section 330 has been depicted in the first to third embodiments of the present disclosure, the key-side load section 120 may directly make contact with and depress the upper electrode support section 330. In this case, the position where the sensor 300 is disposed is different from the position depicted in FIG. 3, and the sensor 300 is disposed beneath the key 100 (for example, at an intermediate position on a line connecting the front end key guide 151 and the side surface key guide 153, in FIG. 3). In this case, the key 100 is connected to the hammer assembly 200 at a place different from the position depicted in FIG. 3. Since the key-side load section 120 directly receives an influence of key depression by the player, it becomes easier for the upper electrode support section 330 to be deviated in the scale direction. Therefore, the effect offered by use of the present disclosure can be obtained more positively.

In addition, the hammer-side load section 210 and the key-side load section 120 may not necessarily depress the upper electrode support section 330. For example, other member separated from the hammer-side load section 210 and the key-side load section 120 may function as an actuator. In this case, the actuator may be a movable part which operates in conjunction with the key.

In addition, while an example in which the upper electrode support section is deviated in the scale direction has been depicted in the first embodiment of the present disclosure, the present disclosure is applicable also to a case where the upper electrode support section is deviated in a direction perpendicular to or oblique to the scale direction, and, further, to a case where the hammer-side load section 210 is rotated and twisted.

Besides, while an example in which the chamfer portions 260 of the contact surface 215 have a tangential shape has been described in the first embodiment of the present disclosure, this is not limitative. The chamfer portions 260 of the contact surface 215 may have a chamfer shape (for example, C chamfer) not having the tangential shape. In this case, it is sufficient that a portion as a corner of the C chamfer (a boundary part between a straight line portion and the chamfer portion) has a smooth shape (circular arc).

Figure 13:
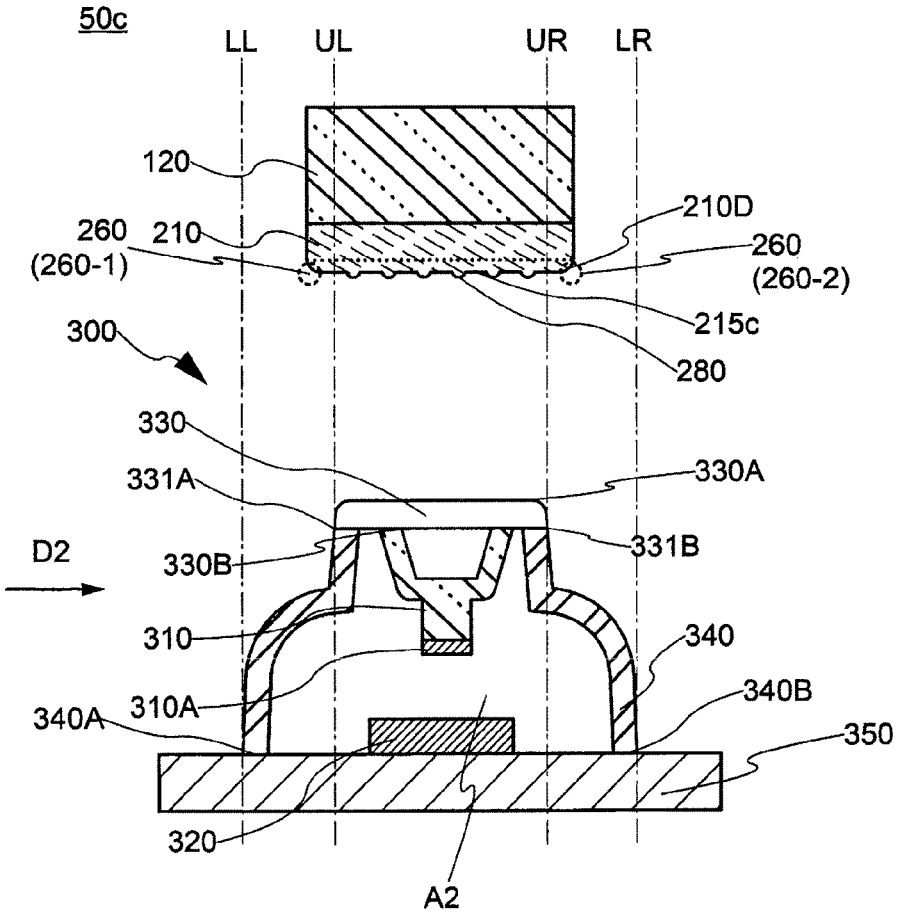
FIG. 13 is an illustration of a modification of the switching device in the third embodiment.

In addition, while an example where the rugged shape (projected and recessed shape) is provided has been depicted in the third embodiment of the present disclosure, FIG. 12 is an illustration of the switching device in the third embodiment. Only recesses may be provided, or only projections may be provided. For example, as depicted in FIG. 13, the switching device 50*c* has a plurality of projections 280. The projection 280 has a semicircular shape. This ensures that biting-in of a contact surface 215*c* of the hammer-side load section 210 into the upper electrode support section 330 or the resultant catching is prevented, and the area of contact between a contact surface 215*c* and the upper electrode support section 330 can be reduced. As a result, an upper electrode 310 is prevented from being deviated due to cohesion or friction between the contact surface of the hammer-side load section 210 and the upper surface 330A of the upper electrode support section 330. Therefore, defective detection in a sensor 300 is prevented. In other words, a keyboard device 1 can generate a sound stably.

The present disclosure contains subject matter related to that disclosed in Japanese Priority Patent Application JP 2017-060148 filed in the Japan Patent Office on Mar. 24, 2017 and PCT/JP2018/010260 filed on Mar. 15, 2018, the entire content of which is hereby incorporated by reference.

It should be understood by those skilled in the art that various modifications, combinations, sub-combinations and alterations may occur depending on design requirements and other factors insofar as they are within the scope of the appended claims or the equivalent thereof.

What is claimed is:

1. A switching device comprising:

a rotatable actuator; and a contact member including an upper surface section that has a flat portion and movable in a vertical direction according to rotation of the actuator, and a deformation section that is disposed between a support member and an end portion of the upper surface section and deforms according to movement of the upper surface section, wherein in a sectional view in a direction perpendicular to a rotary shaft of the actuator and parallel to the support member, a chamfer portion interconnecting a contact surface for contact with the contact member and a side surface, of the actuator, is provided between a virtual plane that contains an end portion in regard of an extending direction of the rotary shaft of the upper surface section of the contact member and that is perpendicular to the upper surface section and a virtual plane that contains an end portion in regard of the extending direction of the rotary shaft of a portion where the deformation section of the contact member makes contact with the support member and that is perpendicular to the upper surface section.

2. The switching device according to claim 1, wherein the chamfer portion has a tangential shape.

3. The switching device according to claim 1, wherein the contact surface of the actuator is formed with a plurality of projections.

4. The switching device according to claim 3, wherein the plurality of projections are rounded.

5. The switching device according to claim 1, wherein the contact surface has a flat surface.

6. The switching device according to claim 5, wherein the chamfer portion is formed at a connection portion between the flat surface and the side surface.

7. The switching device according to claim 1, wherein the contact surface has a curved surface.

8. The switching device according to claim 1, wherein the contact surface has a projection.

9. A keyboard device comprising:

a switching device including a rotatable actuator, and a contact member including an upper surface section that has a flat portion and movable in a vertical direction according to rotation of the actuator, and a deformation section that is disposed between a support member and an end portion of the upper surface section and deforms according to movement of the upper surface section, in a sectional view in a direction perpendicular to a rotary shaft of the actuator and parallel to the support member, a chamfer portion interconnecting a contact surface for contact with the contact member and a side surface, of the actuator, being provided between a virtual plane that contains an end portion in regard of an extending direction of the rotary shaft of the upper surface section of the contact member and that is perpendicular to the upper surface section and a virtual plane that contains an end portion in regard of the extending direction of the rotary shaft of a portion where the deformation section of the contact member makes contact with the support member and that is perpendicular to the upper surface section, wherein the actuator is a hammer.

10. A keyboard device comprising:

a switching device including a rotatable actuator, and a contact member including an upper surface section that has a flat portion and movable in a vertical direction according to rotation of the actuator, and a deformation section that is disposed between a support member and an end portion of the upper surface section and deforms according to movement of the upper surface section, in a sectional view in a direction perpendicular to a rotary shaft of the actuator and parallel to the support member, a chamfer portion interconnecting a contact surface for contact with the contact member and a side surface, of the actuator, being provided between a virtual plane that contains an end portion in regard of an extending direction of the rotary shaft of the upper surface section of the contact member and that is perpendicular to the upper surface section and a virtual plane that contains an end portion in regard of the extending direction of the rotary shaft of a portion where the deformation section of the contact member makes contact with the support member and that is perpendicular to the upper surface section, wherein the actuator is a key.

11. A keyboard device comprising:

a switching device including a rotatable actuator, and a contact member including an upper surface section that has a flat portion and movable in a vertical direction according to rotation of the actuator, and a deformation section that is disposed between a support member and an end portion of the upper surface section and deforms according to movement of the upper surface section, in a sectional view in a direction perpendicular to a rotary shaft of the actuator and parallel to the support member, a chamfer portion interconnecting a contact surface for contact with the contact member and a side surface, of the actuator, being provided between a virtual plane that contains an end portion in regard of an extending direction of the rotary shaft of the upper surface section of the contact member and that is perpendicular to the upper surface section and a virtual plane that contains an end portion in regard of the extending direction of the rotary shaft of a portion where the deformation section of the contact member makes contact with the support member and that is perpendicular to the upper surface section, wherein the actuator is a movable member which is operated in conjunction with a key or a hammer.

* * * * *